US006522091B1

(12) United States Patent
Tsyrganovich

(10) Patent No.: US 6,522,091 B1
(45) Date of Patent: Feb. 18, 2003

(54) CIRCUIT AND METHOD THAT ALLOWS THE AMPLITUDES OF VERTICAL CORRECTION SIGNAL COMPONENTS TO BE ADJUSTED INDEPENDENTLY

(75) Inventor: Anatoliy V. Tsyrganovich, San Jose, CA (US)

(73) Assignee: ZiLOG, Inc., San Jose, CA (US)

( * ) Notice: Subject to any disclaimer, the term of this patent is extended or adjusted under 35 U.S.C. 154(b) by 0 days.

(21) Appl. No.: 09/981,579

(22) Filed: Oct. 17, 2001

(51) Int. Cl.[7] ..... G09G 1/04
(52) U.S. Cl. ..... 315/371; 315/370
(58) Field of Search ..... 315/370, 371, 315/391, 393, 397, 399, 364, 403

(56) References Cited

U.S. PATENT DOCUMENTS 4,642,530 A * 2/1987 Rodriguez-Cavazos ..... 315/371
4,687,972 A * 8/1987 Haferl ..... 315/371
5,583,400 A * 12/1996 Hulshof et al. ..... 315/371
5,814,952 A 9/1998 Maige et al. ..... 315/371
5,877,599 A 3/1999 Hojabri ..... 315/371
6,081,078 A * 6/2000 Truskalo et al. ..... 315/371
6,452,347 B1 * 9/2002 Yamate et al. ..... 315/371

* cited by examiner

*Primary Examiner*—Hoang Nguyen
(74) *Attorney, Agent, or Firm*—Skjerven Morrill LLP

(57) ABSTRACT

The present disclosure describes a technique that allows the amplitudes of vertical correction signal components to be adjusted independently. When the amplitude of each of the vertical correction signal components are set, they will not have to be readjusted when the amplitudes of the other vertical correction signal components are set. This greatly simplifies the process of setting the amplitudes of the vertical correction signal components, saving time and increasing the accuracy of the settings.

23 Claims, 7 Drawing Sheets

CIRCUIT AND METHOD THAT ALLOWS THE AMPLITUDES OF VERTICAL CORRECTION SIGNAL COMPONENTS TO BE ADJUSTED INDEPENDENTLY

BACKGROUND OF THE INVENTION

1. Field of the Invention

The present invention relates to a raster display system and, more particularly, to a circuit and method that allows the amplitudes of vertical correction signal components to be adjusted independently.

2. Related Art

Raster display system are used in a variety of application such as televisions and computer displays. FIG. 1A shows a cross-sectional side view of a conventional raster display system 100. Raster display system 100 includes an electron gun 110, a deflection system 120, and a screen 130. Electron gun 110 generates and accelerates an electron beam 115 toward deflection system 120. Deflection system 120 deflects electron beam 115 horizontally and/or vertically at screen 130. Screen 130 includes a phosphor-coated faceplate that glows or phosphoresces when struck by electron beam 115.

Deflection system 120 includes a horizontal deflection generator 122, a horizontal deflection coil 124, a vertical deflection generator 126, and a vertical deflection coil 128. Horizontal deflection coil 124 and vertical deflection coil 128 are collectively referred to as the yoke. Although not shown, horizontal deflection coil 124 and vertical deflection coil 128 are wound a ninety-degree angle relative to one another. Horizontal deflection generator 122 generates a horizontal deflection current signal $I_H$. When horizontal deflection current signal $I_H$ passes through horizontal deflection coil 124, a magnetic field is created that deflects electron beam 115 horizontally. The horizontal angle of deflection (not shown) is proportional to the direction and the magnitude of horizontal deflection current signal $I_H$. Similarly, vertical deflection generator 126 generates a vertical deflection current signal $I_V$. When vertical deflection current signal $I_V$ passes through vertical deflection coil 128, a magnetic field is created that deflects electron beam 115 vertically. The vertical angle of deflection $\theta$ is proportional to the direction and the magnitude of vertical deflection current signal $I_V$.

FIG. 1B is a front view of raster display system 100. Deflection system 120 deflects electron beam 115 from a first side of screen 130 to a second side of screen 130 to draw a first line $L_1$. Electron beam 115 is then briefly turned off, moved downward, and brought back to the first side of screen 130 by deflection system 120. Electron beam 115 is then turned on and deflection system 120 deflects electron beam 115 from the first side of screen 120 to the second side of screen 130 to draw a second line $L_2$. This process continues very rapidly so that lines $L_3$ through $L_N$ (where N=1, 2, 3, . . . , N) are drawn thereby creating a raster on screen 130.

To produce an accurate image, the distance $d_N$ (where n=1, 2, 3, . . . , N) between each horizontal line $L_N$ drawn on screen 130 must be equal as shown in FIG. 1B. The distance between each horizontal line $d_N$ is a function of two factors: the vertical angle of deflection $\theta$ and the shape of screen 130. If the shape of the screen is spherical, a vertical deflection current signal $I_V$ having a sawtooth shaped waveform can be used. A sawtooth shaped waveform can be used since the distance from the point of deflection 129 to the upper, center, and lower portions of the curved screen is constant. If the shape of the screen is non-spherical (e.g., a flat screen), a vertical deflection current signal $I_V$ having a more complex S-shaped waveform must be used. An S-shaped waveform must be used since the distance from the point of deflection 129 to the upper and lower portions of a non-spherical screen is greater than the distance from the point of deflection 129 to the center portions of a non-spherical screen. Note that if the shape of the screen is non-spherical and a vertical deflection current signal $I_V$ having a sawtooth shaped waveform is used, the distance $d_N$ between horizontal lines $L_N$ drawn on screen 130 will not be an equal from one another as shown in FIG. 1C. This degrades the quality of the image drawn on screen 130 and thus is commercially undesirable.

As is well-known in the art, an S-shaped waveform can be produced by combining a sawtooth waveform with higher-order odd multiples of the sawtooth waveform. In particular, S-shaped waveforms be produced by combining the following components: a first-order signal component (i.e., a sawtooth signal), a third-order signal component, and a fifth-order signal component. Other higher-order odd signal components can also be combined with the sawtooth waveform to produce a more complex S-shaped waveform. FIG. 2 shows waveforms for a first-order signal component 210, a third-order signal component 220, and a fifth-order signal component 230, respectively.

FIG. 3 shows a conventional horizontal deflection generator circuit 300 that can be used to generate a vertical deflection current signal $I_V$ having an S-shaped waveform. Horizontal deflection generator circuit 300 includes a first-order signal generator 302, a first-order amplitude signal generator 304, a multiplier 306, a third-order signal generator 308, a third-order amplitude signal generator 310, a multiplier 312, a fifth-order signal generator 314, a fifth-order amplitude signal generator 316, a multiplier 318, and a signal combiner 320.

In operation, first-order signal generator 302 generates a first-order signal $S^1$ and first-order amplitude signal generator 304 generates a first-order amplitude signal $A_1$. Multiplier 306 multiplies first-order signal $S^1$ with first-order amplitude signal $A_1$ to generate a first-order vertical correction signal component $A_1S^1$. Third-order signal generator 308 generates a third-order signal $S^3$ and third-order amplitude signal generator 310 generates a third-order amplitude signal $A_3$. Multiplier 312 multiplies third-order signal $S^3$ with third-order amplitude signal $A_3$ to generate a third-order vertical correction signal component $A_3S^3$. Fifth-order signal generator 314 generates a fifth-order signal $S^5$ and fifth-order amplitude signal generator 316 generates a fifth-order amplitude signal $A_5$. Multiplier 318 multiplies fifth-order signal $S^5$ with fifth-order amplitude signal $A_5$ to generate a fifth-order vertical correction signal component $A_5S^5$.

Signal combiner 320 combines the vertical correction signal components $A_1S^1$, $A_3S^3$, and $A_5S^5$ to produce vertical correction signal $A_VS^V$. Vertical correction signal $A_VS^V$ can be equivalent to vertical deflection current signal $I_V$, or vertical correction signal $A_VS^V$ can be further processed (e.g., amplified) prior to becoming vertical deflection current signal $I_V$.

During the manufacturing process of a raster display system, a user must adjust amplitude signals $A_1$, $A_3$, and $A_5$ so that lines $L_1$ through line $L_N$ (where N=1, 2, 3, . . . , N) are properly drawn on screen 130. First, the user adjusts amplitude signal $A_1$ so that line $L_1$ is drawn at the proper position at the top of screen 130. This is referred to as setting the vertical size (i.e., the maximum angle of vertical deflection $\theta_{MAX}$). Next, the user adjusts amplitude signals $A_3$ and $A_5$ so that the distances $d_N$ between each horizontal line $L_N$ drawn on screen 130 are equal as shown in FIG. 1B. Unfortunately, when the user adjusts amplitude signals $A_3$ and $A_5$, the vertical size changes. As a result, the user must readjust amplitude signal $A_1$ to reposition line $L_1$ at the proper position at the top of screen 130. However, the readjustment of amplitude signal $A_1$ causes the distances $d_N$ between each horizontal line $L_N$ drawn on screen 130 to become unequal again. Consequently, the user must readjust amplitude signals $A_3$ and $A_5$ so that the distances $d_N$ between each horizontal line $L_N$ drawn on screen 130 are equal. Unfortunately, the adjustment of amplitude signals $A_3$ and $A_5$ again causes the vertical size to change. As a result, the user must readjust amplitude signal $A_1$ to reposition line $L_1$ at the proper position at the top of screen 130. This time-consuming, inexact, trial-and-error process must be performed numerous times before amplitude signals $A_1$, $A_3$, and $A_5$ are properly set.

Accordingly, what is needed is a circuit and method that allows the amplitudes of vertical correction signal components to be adjusted independently.

SUMMARY OF THE INVENTION

The present invention provides a technique that allows the amplitudes of vertical correction signal components to be adjusted independently. When the amplitude of each of the vertical correction signal components are set, they will not have to be readjusted when the amplitudes of the other vertical correction signal components are set. This greatly simplifies the process of setting the amplitudes of the vertical correction signal components, saving time and increasing the accuracy of the settings.

In one embodiment of the present invention, a circuit that allows the amplitudes of vertical correction signal components to be adjusted independently is provided. The circuit includes a first signal combiner having a first input coupled to receive a first-order amplitude signal and a second input coupled to receive a third-order amplitude signal, a first multiplier having a first input coupled to receive a first-order signal and a second input coupled to receive an output signal of the first signal combiner, a second multiplier having a first input coupled to receive a third-order signal and a second input coupled to receive the third-order amplitude signal, and a second signal combiner having a first input coupled to receive an output signal of the first multiplier and a second input coupled to receive an output signal of the second multiplier.

In another embodiment of the present invention, a method that allows the amplitudes of vertical correction signal components to be adjusted independently is provided. The method includes combining a first-order amplitude signal with a third-order amplitude signal to generate a modified first-order amplitude signal, multiplying a first-order signal with the modified first-order amplitude signal to generate a first-order vertical correction signal component, multiplying a third-order signal with the third-order amplitude signal to generate a third-order vertical correction signal component, and combining the first-order vertical correction signal component with the third-order vertical correction signal component.

In another embodiment of the present invention, a method for generating a vertical deflection current signal including a first vertical correction signal component and a second vertical correction component is provided. The method includes setting an amplitude of the first vertical correction signal component, and setting an amplitude of the second vertical correction signal component, wherein the amplitude of the first vertical correction signal component will not have to be reset after the amplitude of the second vertical correction signal component has been set.

Other embodiments, aspects, and advantages of the present invention will become apparent from the following descriptions and the accompanying drawings.

BRIEF DESCRIPTION OF THE DRAWINGS

For a more complete understanding of the present invention and for further embodiments, aspects, and advantages, reference is now made to the following description taken in conjunction with the accompanying drawings, in which.

DETAILED DESCRIPTION OF THE INVENTION

Figure 1A:
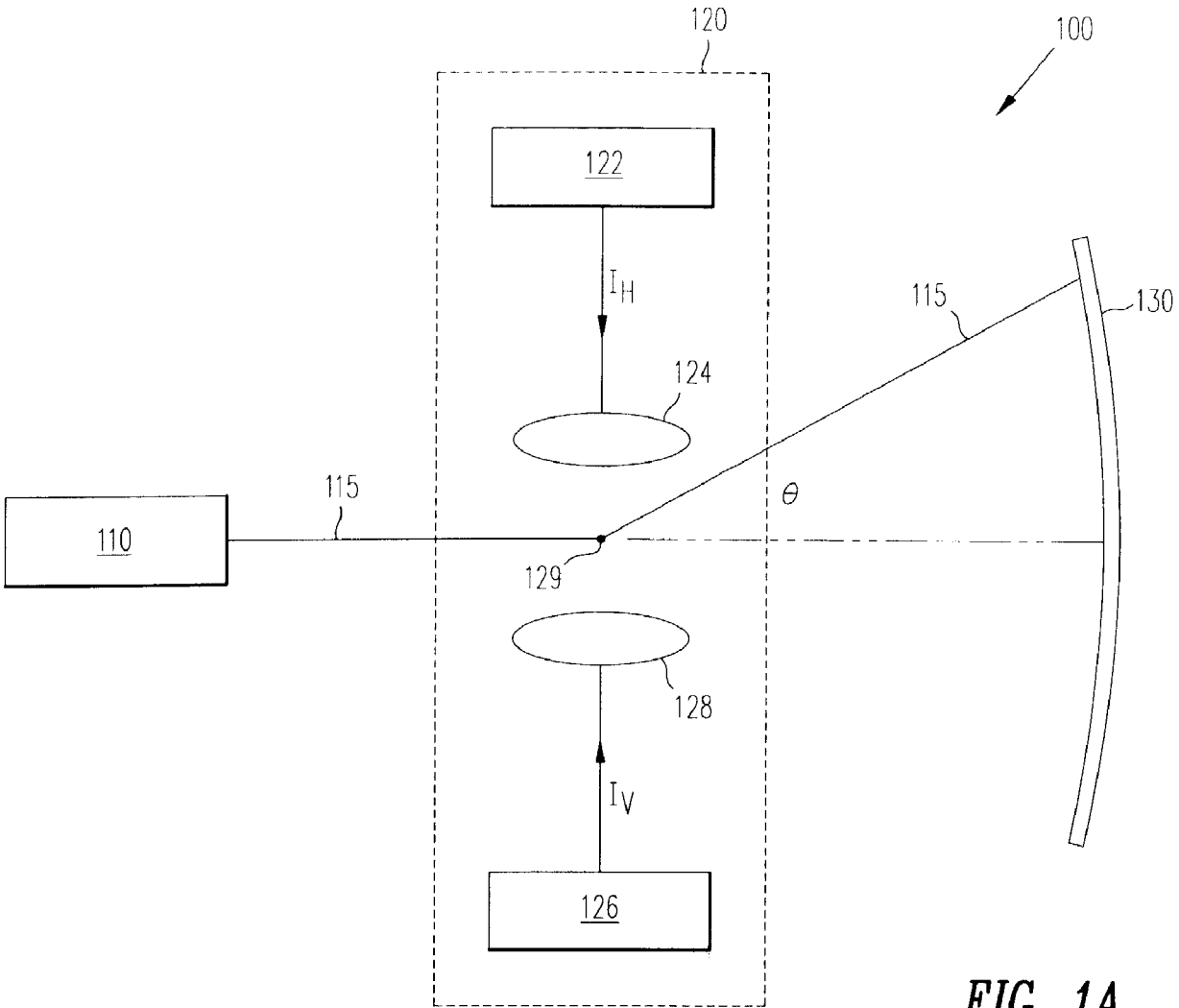
FIG. 1A shows a cross-sectional side view of a conventional raster display system.
Figure 1B:
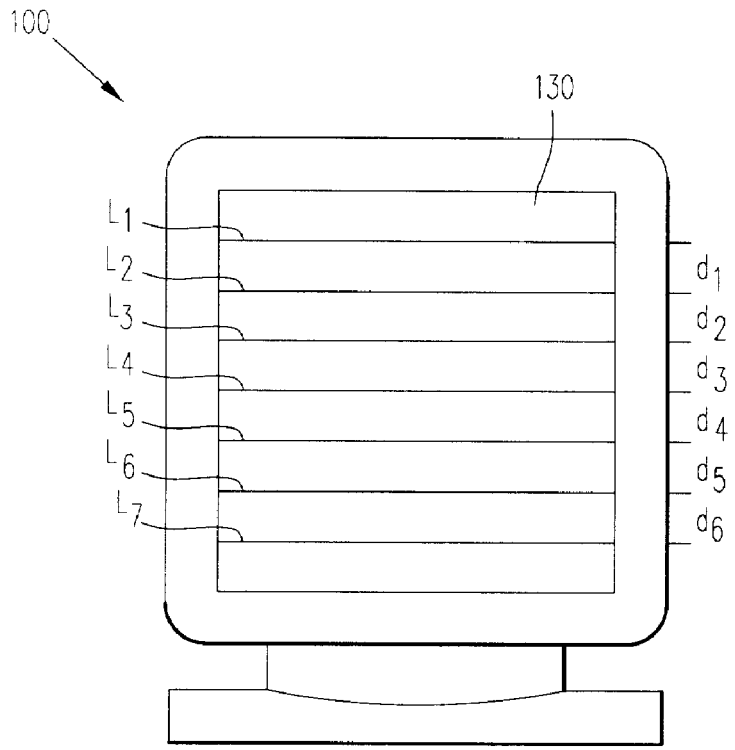
FIG. 1B shows a front view of a raster display system.
Figure 1C:
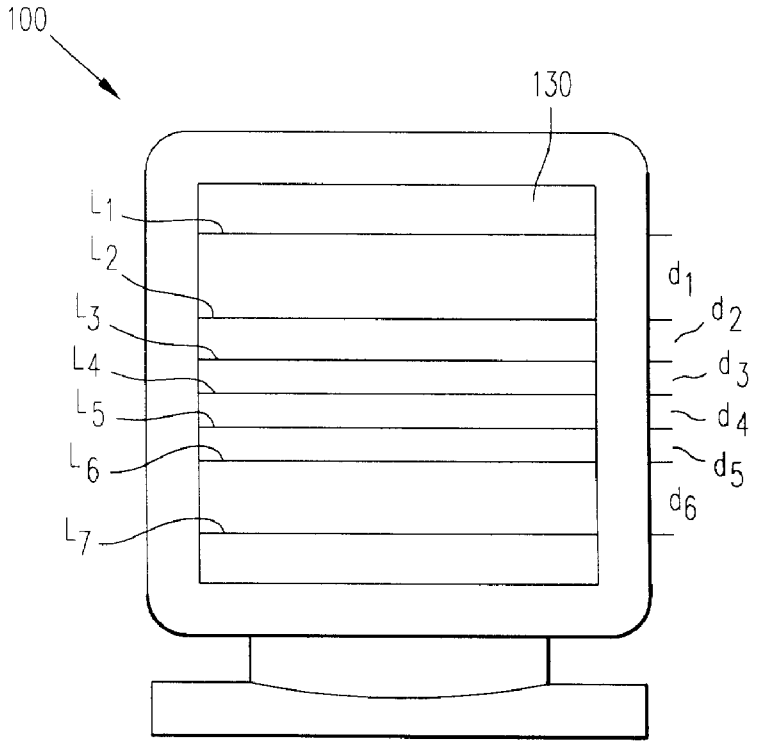
FIG. 1C shows a front view of a raster display system.
Figure 2:
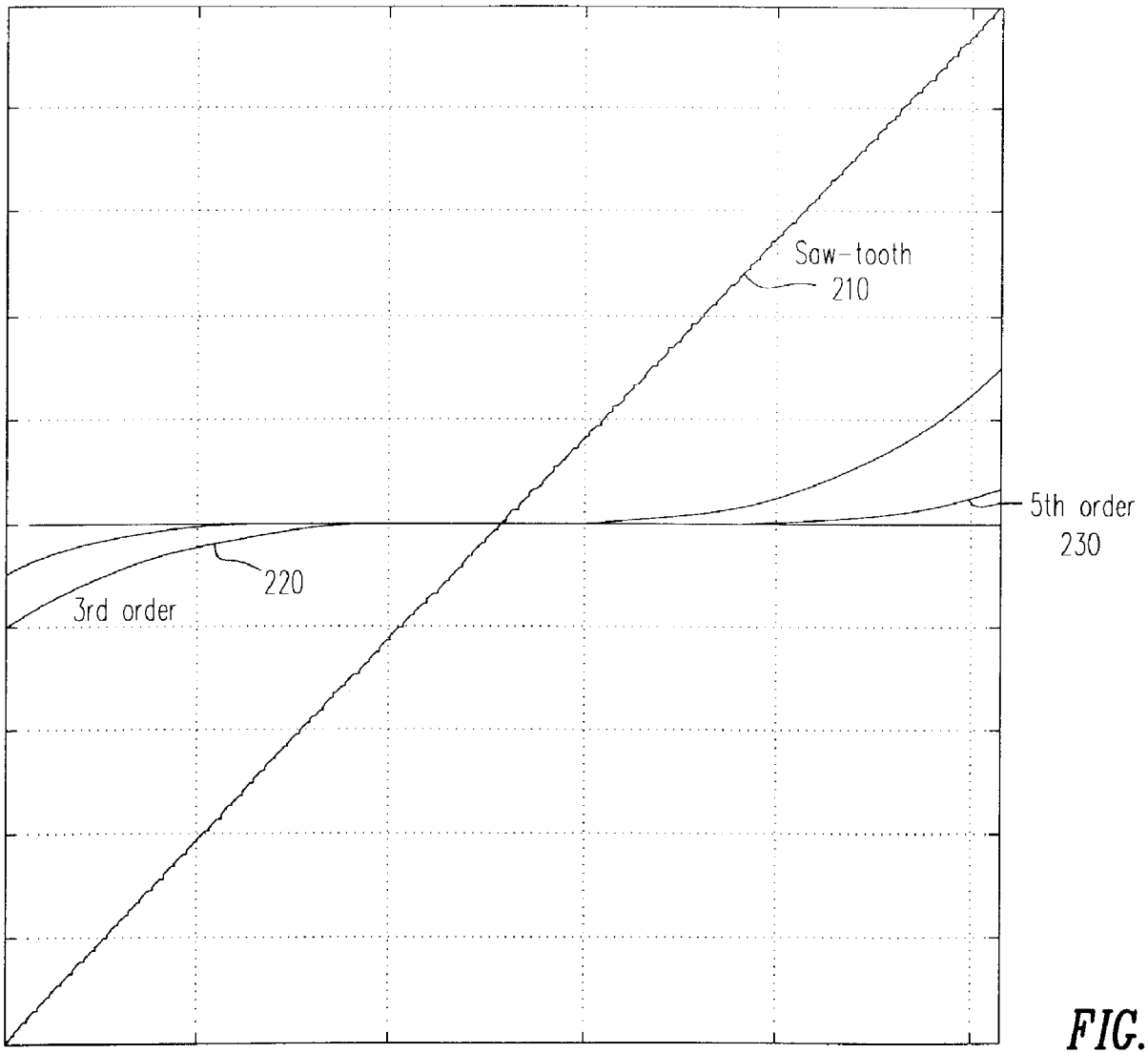
FIG. 2 shows waveforms for a first-order signal, a third-order signal, and a fifth-order signal.
Figure 3:
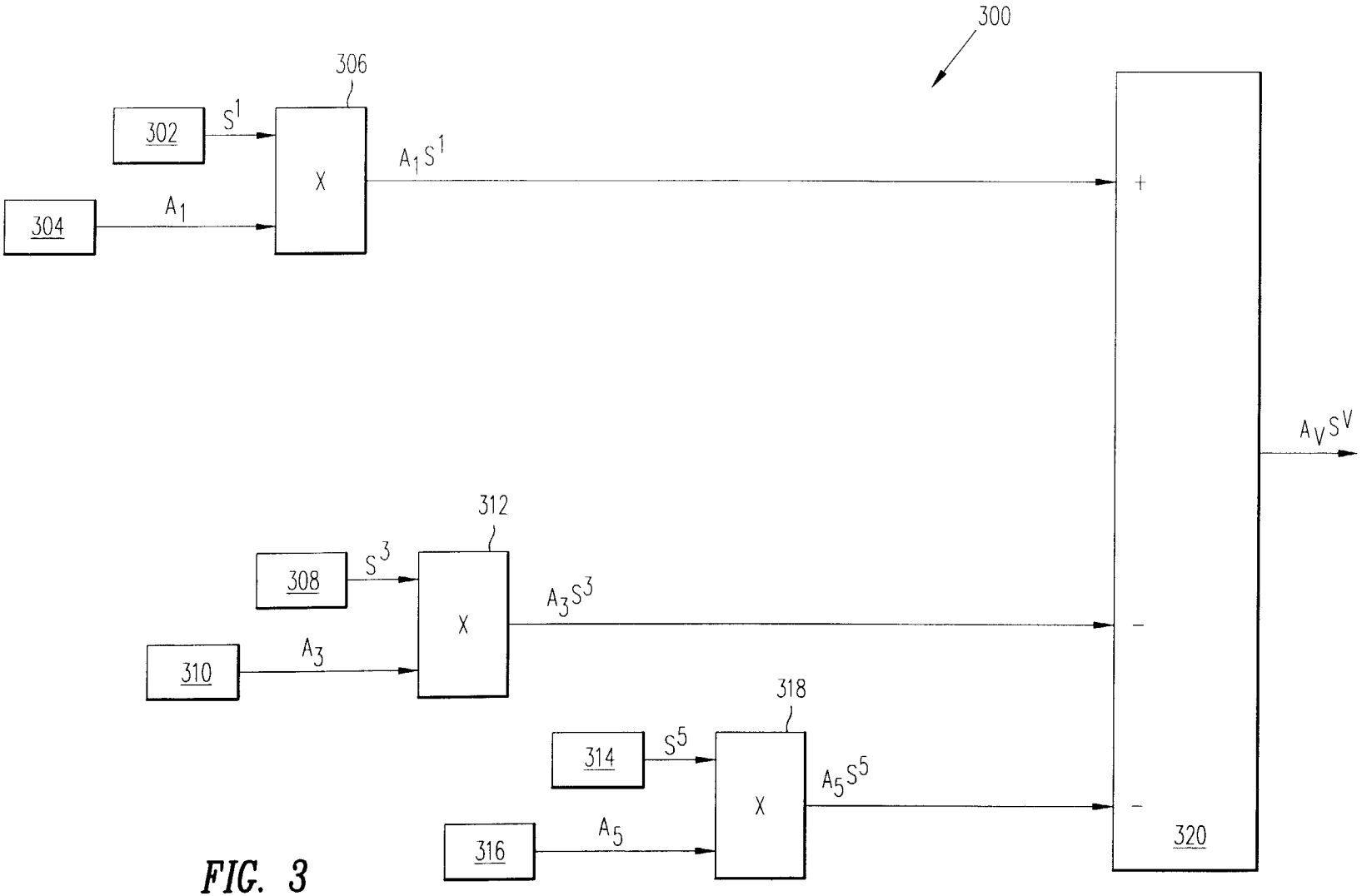
FIG. 3 shows a conventional vertical deflection generator circuit.
Figure 4:
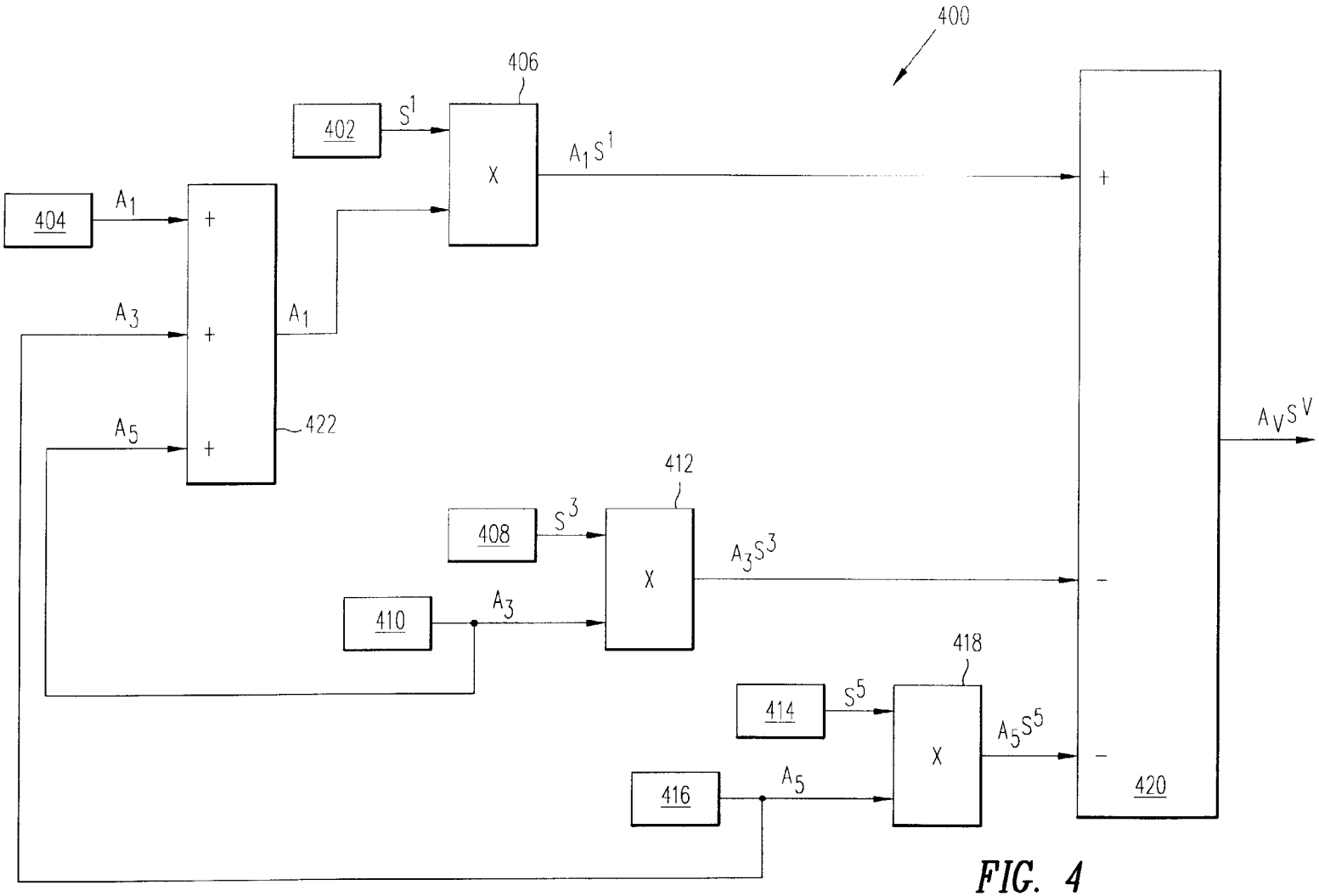
FIG. 4 shows a vertical deflection generator circuit, according to some embodiments of the present invention.
Figure 5:
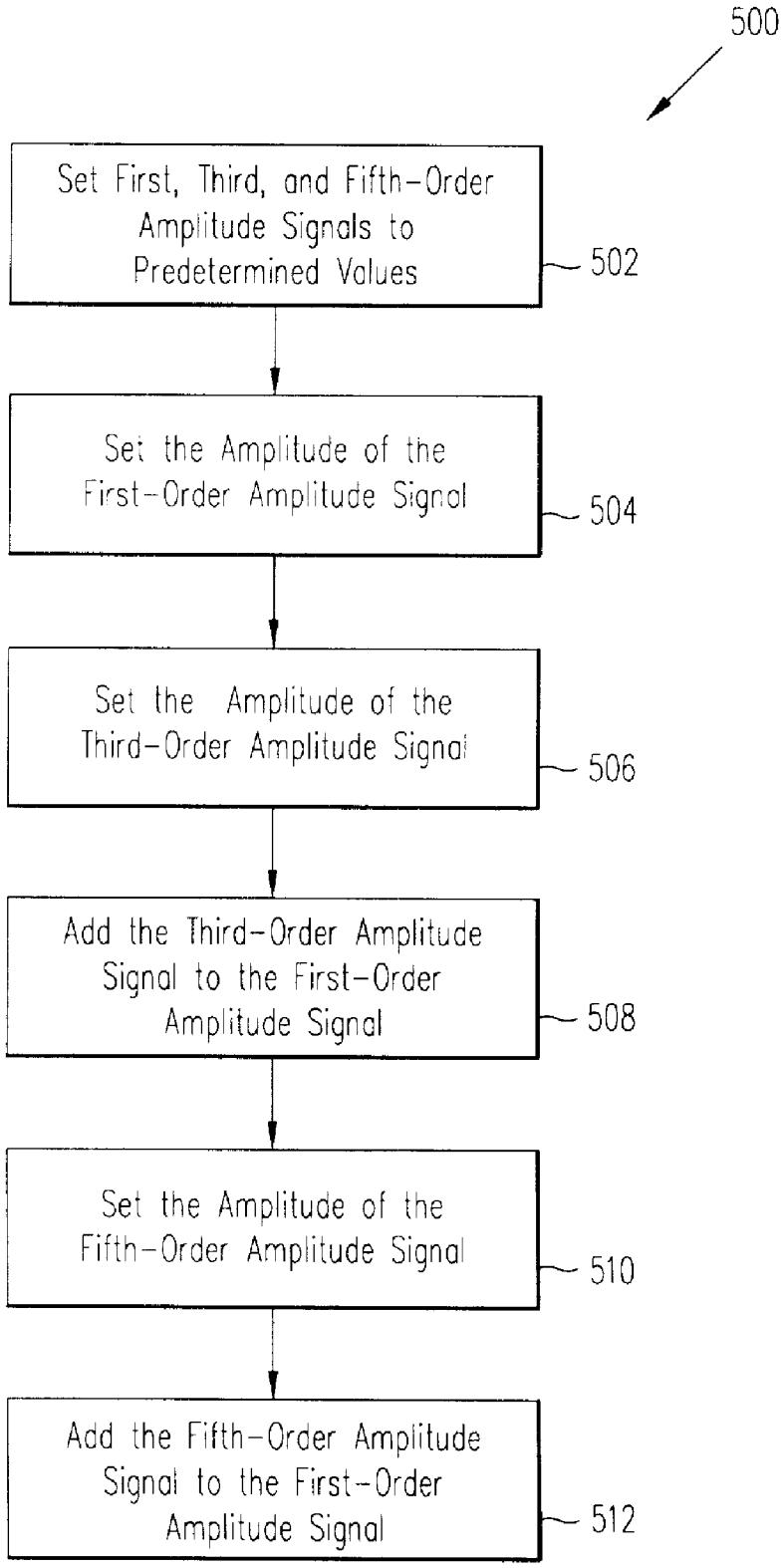
FIG. 5 shows a flowchart of an exemplary method of operation for the vertical deflection generator circuit of FIG. 4, according to some embodiments of the present invention.
Figure 6:
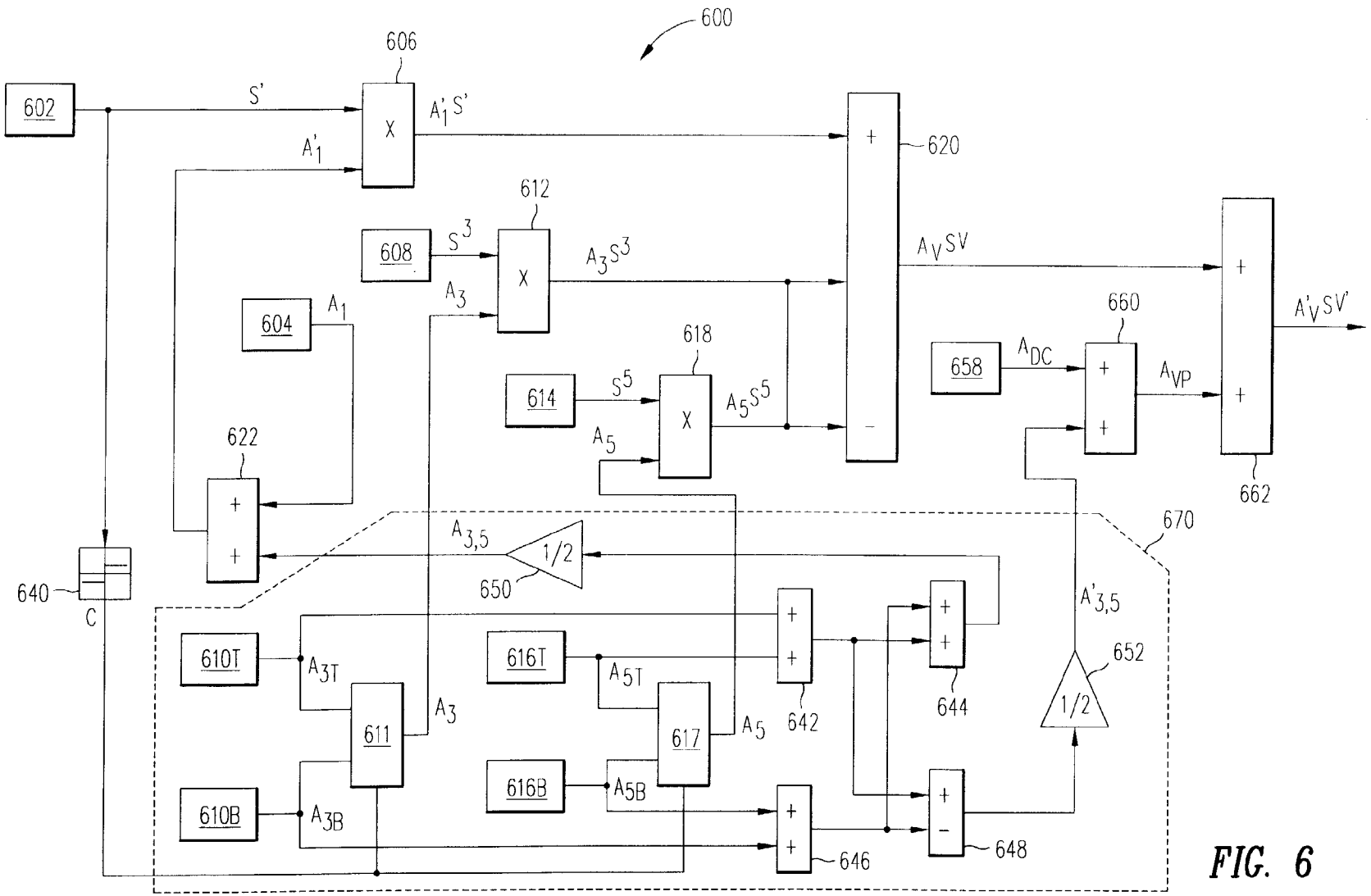
FIG. 6 shows a vertical deflection generator circuit that allows for independent S corrections to the top half and the bottom half of a raster display, according to some embodiments of the present invention.

The preferred embodiments of the present invention and their advantages are best understood by referring to FIGS. 4 through 6 of the drawings. Like reference numerals are used for like and corresponding parts of the various drawings.

Circuit that Allows the Amplitudes of Vertical Correction Signal Components to be Adjusted Independently FIG. 4 shows a deflection generator circuit 400, according to some embodiments of the present invention. Deflection generator circuit 400 allows the amplitudes of vertical correction signal components to be adjusted independently. Deflection generator circuit 400 can be implemented in hardware, firmware/microcode; software, or any combination thereof. Additionally, deflection generator circuit 400 can be implemented on a single integrated circuit device or integrated with other integrated circuits on a single integrated circuit device.

Deflection generator circuit 400 includes a first-order signal generator 402, a first-order amplitude signal generator 404, a multiplier 406, a third-order signal generator 408, a third-order amplitude signal generator 410, a multiplier 412, a fifth-order signal generator 414, a fifth-order amplitude signal generator 416, a multiplier 418, a signal combiner 420, and a signal combiner 422.

First-order signal generator 402 generates a first-order signal $S^1$ and signal combiner 422 outputs a modified first-order amplitude signal $A_1'$. Multiplier 406 multiplies first-order signal $S^1$ with modified first-order amplitude signal $A_1'$ to generate a modified first-order vertical correction signal component $A_1'S^1$. Third-order signal generator 408 generates a third-order signal $S^3$ and third-order amplitude signal generator 410 generates a third-order amplitude signal $A_3$. Multiplier 412 multiplies third-order signal $S^3$ with third-order amplitude signal $A_3$ to generate a third-order vertical correction signal component $A_3S^3$. Fifth-order signal generator 414 generates a fifth-order signal $S^5$ and fifth-order amplitude signal generator 416 generates a fifth-order amplitude signal $A_5$. Multiplier 418 multiplies fifth-order signal $S^5$ with fifth-order amplitude signal $A_5$ to generate a fifth-order vertical correction signal component $A_5S^5$. For clarity, a third-order signal generator 408 and a fifth-order signal generator 414 are shown. However, it should be recognized that an independent third-order signal generator 408 and a fifth-order signal generator 414 are not needed since first-order signal $S^1$ can be provided to multipliers that generate third-order signal $S^3$ and fifth-order signal $S^5$. In some embodiments, first-order amplitude signal generator 404, third-order amplitude signal generator 410, and fifth-order amplitude signal generator 416 are N-bit registers (where N is a positive integer) that can be programmed by a user.

Signal combiner 420 combines the vertical correction signal components $A_1'S^1$, $A_3S^3$, and $A_5S^5$ to produce vertical correction signal $A_VS^V$. More specifically, signal combiner 420 subtracts vertical correction signal components $A_3S^3$ and $A_5S^5$ from vertical correction signal component $A_1'S'$ to produce vertical correction signal $A_VS^V$. Vertical correction signal $A_VS^V$ can be equivalent to vertical deflection current signal $I_V$, or vertical correction signal $A_VS^V$ can be further processed (e.g., amplified) prior to becoming vertical deflection current signal $I_V$.

Signal combiner 422 combines first-order amplitude signal $A_1$, which is generated by first-order amplitude signal generator 404, with third-order amplitude signal $A_3$, and fifth-order amplitude signal $A_5$ to generate modified first-order amplitude signal $A_1'$. More specifically, signal combiner 422 adds third-order amplitude signal $A_3$ and fifth-order amplitude signal $A_5$ to first-order amplitude signal $A_1$ to produce modified first-order amplitude signal $A_1'$. As described above, modified first-order amplitude signal $A_1'$ is then multiplied with first-order signal $S^1$ to generate modified first-order vertical correction signal component $A_1'S^1$.

The reason that third-order amplitude signal $A_3$ and fifth-order amplitude signal $A_5$ are added to first-order amplitude signal $A_1$ in signal combiner 422 is because third-order amplitude signal $A_3$ and fifth-order amplitude signal $A_5$ are subtracted from modified first-order amplitude signal $A_1'$ in signal combiner 420. When third-order amplitude signal $A_3$ and fifth-order amplitude signal $A_5$ are subtracted from modified first-order amplitude signal $A_1'$ in signal combiner 420, the amplitude $A_V$ of vertical correction signal $A_VS^V$ decreases. However, as explained above, the amplitude $A_V$ of vertical correction signal $A_VS^V$ should remain constant so that the vertical size remains constant. By adding third-order amplitude signal $A_3$ and fifth-order amplitude signal $A_5$ to first-order amplitude signal $A_1$ in signal combiner 422, the amplitude of modified first-order amplitude signal $A_1'$ is increased and thus compensates for the decrease in the amplitude $A_V$ of vertical correction signal $A_VS^V$. Consequently, first-order amplitude signal $A_1$ will not have to be readjusted after third-order amplitude signal $A_3$ and fifth-order amplitude signals $A_5$ have been set. As those of skill in the art will recognize, this greatly simplifies the process setting amplitude signals $A_1$, $A_3$, and $A_5$.

It should be recognized that deflection generator circuit 400 can also include other circuitry. For example, deflection generator circuit 400 may include a second-order signal generator, a second-order amplitude signal generator, and a multiplier for multiplying the second-order signal with the second-order amplitude signal to produce a second-order vertical correction signal component. The second-order vertical correction signal component can then be combined with the other vertical correction signal components in signal combiner 420. The second-order vertical correction signal provides what is commonly referred to as C correction. The second-order vertical correction signal or C correction signal is used to compensate for top/bottom asymmetry in the vertical deflection coil.

Method that Allows the Amplitudes of Vertical Correction Signal Components to be Adjusted Independently FIG. 5 is a flowchart of an exemplary method 500 of operation for vertical deflection generator circuit 400. Method 500 describes how the amplitudes of vertical correction signal components can be adjusted independently. Method 500 can be performed by a human operator, by automated devices, or by any combination thereof, and method 500 can be performed using hardware, firmware/microcode, software, or any combination thereof. Additionally, method 500 can be performed on a single integrated circuit device.

In step 502, first-order amplitude signal $A_1$, third-order amplitude signal $A_3$, and fifth-order amplitude signal $A_5$ are set to predetermined values. The predetermined values can be optimal values that have been determined from testing. This step can be accomplished by programming first-order amplitude signal generator 404, third-order amplitude signal generator 410, and fifth-order amplitude signal generator 416 to output predetermined values.

In step 504, the amplitude of first-order amplitude signal $A_1$ is set. More specifically, the amplitude of first-order amplitude signal $A_1$ is set such that vertical correction signal $A_VS^V$ causes the electron beam to be positioned at a desired position at the top of a screen. This is generally referred to as setting the vertical size.

In step 506, the amplitude of third-order amplitude signal $A_3$ is set. Third-order amplitude signal $A_3$ introduces third-order non-linearities into vertical correction signal $A_VS^V$. The third-order non-linearities make vertical correction signal $A_VS^V$ non-linear or S-shaped and thus correct for the non-spherical shape of the screen.

In step 508, third-order amplitude signal $A_3$ is added to first-order amplitude signal $A_1$. In this step, third-order amplitude signal $A_3$ is fed into signal combiner 422 where it is added to first-order amplitude signal $A_1$ to generate modified first-order amplitude signal $A_1'$. The reason third-order amplitude signal $A_3$ is added to first-order amplitude signal $A_1$ is because third-order vertical correction signal component $A_3S^3$ now exists and is subtracted from modified first-order vertical correction signal component $A_1'S^1$ in signal combiner 420. When third-order vertical correction signal component $A_3S^3$ is subtracted from modified first-order vertical correction signal component $A_1'S^1$, the amplitude $A_V$ of vertical correction signal $A_VS^V$ decreases. However, as explained above, the amplitude $A_V$ of vertical correction signal $A_VS^V$ should remain constant so that the vertical size remains constant. By adding third-order amplitude signal $A_3$ to first-order amplitude signal $A_1$ in signal combiner 422, the amplitude of modified first-order amplitude signal $A_1'$ is increased and thus compensates for the decrease in the amplitude $A_V$ of vertical correction signal $A_VS^V$. Consequently, first-order amplitude signal $A_1$ will not have to be readjusted after third-order amplitude signal $A_3$ has been set. As those of skill in the art will recognize, this greatly simplifies the process setting amplitude signals $A_1$ and $A_3$.

In step 510, the amplitude of fifth-order amplitude signal $A_5$ is set. Fifth-order amplitude signal A5 introduces fifth-order non-linearities into vertical correction signal $A_VS^V$. The fifth-order non-linearities make vertical correction signal $A_VS^V$ non-linear or S-shaped and thus correct for the flatness of the screen. Fifth-order non-linearities are typically introduced when the third-order non-linearities (introduced in step 506) do not adequately correct for the non-spherical shape of a screen. It should be recognized that higher-order amplitude signals can also be introduced into vertical correction signal $A_VS^V$.

In step 512, fifth-order amplitude signal $A_5$ is added to first-order amplitude signal $A_1$. In this step, fifth-order amplitude signal $A_5$ is fed into signal combiner 422 where it is added to first-order amplitude signal $A_1$ and third-order amplitude signal $A_3$ to generate modified first-order amplitude signal $A_1'$. The reason fifth-order amplitude signal $A_5$ is added to first-order amplitude signal $A_1$ and third-order amplitude signal $A_3$ is because fifth-order vertical correction signal component $A_5S^5$ now exists and is subtracted from modified first-order vertical correction signal component $A_1'S^1$. When fifth-order vertical correction signal component $A_5S^5$ is subtracted from modified first-order vertical correction signal component $A_1'S^1$ the amplitude $A_V$ of vertical correction signal $A_VS^V$ decreases. However, as explained above, the amplitude $A_V$ of vertical correction signal $A_VS^V$ should remain constant so that the vertical size remains constant. By adding fifth-order amplitude signal $A_5$ to first-order amplitude signal $A_1$ and third-order amplitude signal $A_3$ in signal combiner 422, the amplitude of modified first-order amplitude signal $A_1'$ is increased and thus compensates for the decrease in the amplitude $A_V$ of vertical correction signal $A_VS^V$. Consequently, first-order amplitude signal $A_1$ will not have to be readjusted after third-order amplitude signal $A_3$ has been set. As those of skill in the art will recognize, this greatly simplifies the process setting amplitude signals $A_1$, $A_3$, and $A_5$.

When compared with conventional techniques, method 500 is advantageous since a user will not have to make successive adjustments to amplitude signals $A_1$, $A_3$, and $A_5$. Consequently, method 500 greatly simplifies the process setting amplitude signals $A_1$, $A_3$, and $A_5$.

Circuit that Allows the Amplitudes of Vertical Correction Signal Components to be Adjusted Independently and that Allows for Independent Top and Bottom S Corrections FIG. 6 shows a deflection generator circuit 600, according to some embodiments of the present invention. Deflection generator circuit 600 is similar to deflection generator circuit 400. However, in addition to allowing the amplitudes of vertical correction signal components to be adjusted independently, deflection generator circuit 600 also allows for independent S corrections to the top half and the bottom half of a raster display using independent top-bottom correction circuit 670. Deflection generator circuit 600 can be implemented in hardware, firmware/microcode, software, or any combination thereof. Additionally, deflection generator circuit 600 can be implemented on a single integrated circuit device or integrated with other integrated circuits on a single integrated circuit device.

Deflection generator circuit 600 includes a first-order signal generator 602, a first-order amplitude signal generator 604, a multiplier 606, a third-order signal generator 608, a third-order top amplitude signal generator 610T, a third-order bottom amplitude signal generator 610B, a multiplexer 611, a multiplier 612, a fifth-order signal generator 614, a fifth-order top amplitude signal generator 616T, a fifth-order bottom amplitude signal generator 616B, a multiplexer 617, a multiplier 618, a signal combiner 620, a signal combiner 622, a control signal generator 640, signal combiners 642, 644, 646, and 648, divide-by-two elements 650 and 652, a DC signal generator 658, and signal combiners 660, and 662.

Independent top-bottom correction circuit 670 includes third-order top amplitude signal generator 610T, third-order bottom amplitude signal generator 610B, multiplexer 611, fifth-order top amplitude signal generator 616T, fifth-order bottom amplitude signal generator 616B, multiplexer 617, signal combiners 642, 644, 646, and 648, and divide-by-two elements 650 and 652.

First-order signal generator 602 generates a first-order signal $S^1$ and signal combiner 622 outputs a modified first-order amplitude signal $A_1'$. Multiplier 606 multiplies first-order signal $S^1$ with modified first-order amplitude signal $A_1'$ to generate a modified first-order vertical correction signal component $A_1'S^1$.

Third-order signal generator 608 generates a third-order signal $S^3$. Third-order top amplitude signal generator 610T generates a third-order top amplitude signal $A_{3T}$, and third-order bottom amplitude signal generator 610B generates a third-order bottom amplitude signal $A_{3B}$. Multiplexer 611 outputs a third-order amplitude signal $A_3$, which is either third-order top amplitude signal $A_{3T}$ or third-order bottom amplitude signal $A_{3B}$ depending on the value of control signal C. Multiplier 612 multiplies third-order signal $S^3$ with third-order amplitude signal $A_3$ to generate a third-order vertical correction signal component $A_3S^3$.

Fifth-order signal generator 614 generates a fifth-order signal $S^5$. Fifth-order top amplitude signal generator 616T generates a fifth-order top amplitude signal $A_{5T}$, and fifth-order bottom amplitude signal generator 616B generates a fifth-order bottom amplitude signal $A_{5B}$. Multiplexer 617 outputs a fifth-order amplitude signal $A_5$, which is either fifth-order top amplitude signal $A_{5T}$ or fifth-order bottom amplitude signal $A_{5B}$ depending on the value of control signal C. Multiplier 618 multiplies fifth-order signal $S^5$ with fifth-order amplitude signal $A_5$ to generate a fifth-order vertical correction signal component $A_5S^5$.

For clarity, a third-order signal generator 608 and a fifth-order signal generator 614 are shown. However, it should be recognized that an independent third-order signal generator 608 and a fifth-order signal generator 614 are not needed since first-order signal $S^1$ can be provided to multipliers that generate third-order signal $S^3$ and fifth-order signal $S^5$. In some embodiments, first-order amplitude signal generator 604, third-order top amplitude signal generator 610T, third-order bottom amplitude signal generator 610B, fifth-order top amplitude signal generator 616T, and fifth-order bottom amplitude signal generator 616B are N-bit registers (where N is a positive integer) that can be programmed by a user.

Control signal generator 640 generates control signal C. More specifically, control signal generator 640 receives first-order signal $S^1$ (i.e., a sawtooth signal) and determines whether the current value of first-order signal $S^1$ is positive or negative. When the current value of first-order signal $S^1$ is positive, the top half of the raster display is being drawn and control signal generator 640 outputs a logic low signal for control signal C. This causes third-order top amplitude signal $A_{3T}$ to be output from multiplexer 611 as third-order amplitude signal $A_3$, and causes fifth-order top amplitude signal $A_{5T}$ to be output from multiplexer 617 as fifth-order amplitude signal $A_5$. When the current value of first-order signal $S^1$ is negative, the bottom half of the raster display is being drawn and control signal generator 640 output a logic high signal for control signal C. This causes third-order bottom amplitude signal $A_{3B}$ to be output from multiplexer 611 as third-order amplitude signal $A_3$, and causes fifth-order bottom amplitude signal $A_{5B}$ to be output from multiplexer 617 as fifth-order amplitude signal $A_5$. Accordingly, the amplitudes of third-order vertical correction signal component $A_3S^3$ and fifth-order vertical correction signal component $A_5S^5$ can be independently controlled for the top and bottom halves of the raster display.

Signal combiner 620 combines the vertical correction signal components $A_1'S^1$, $A_3S^3$, and $A_5S^5$ to produce vertical correction signal $A_VS^V$. More specifically, signal combiner 620 subtracts vertical correction signal components $A_3S^3$ and $A_5S^5$ from vertical correction signal component $A_1'S$ to produce vertical correction signal $A_VS^V$.

Signal combiner 622 combines first-order amplitude signal $A_1$ generated by first-order amplitude signal generator 604 with signal $A_{3,5}$ to generate modified first-order amplitude signal $A_1'$. More specifically, signal combiner 622 adds signal $A_{3,5}$ to first-order amplitude signal $A_1$ to produce modified first-order amplitude signal $A_1'$. As described above, modified first-order amplitude signal $A_1'$ is then multiplied with first-order signal $S^1$ to generate modified first-order vertical correction signal component $A_1'S^1$. Signal $A_{3,5}$ is generated by independent top and bottom correction circuit 670 and can be described by the following equation: $A_{3,5}=(A_{3T}+A_{5T})/2+(A_{3B}+A_{5B})/2$.

Signal combiner 660 combines signal $A'_{3,5}$ and signal $A_{DC}$ to generate a vertical position signal $A_{VP}$. Signal $A_{DC}$ is generated by DC signal generator 658 and is used to control the vertical position of the electron beam. Signal $A'_{3,5}$ is generated by independent top and bottom correction circuit 670 and can be described by the following equation: $A'_{3,5}=(A_{3T}+A_{5T})/2-(A_{3B-A5B})/2$.

Signal combiner 662 combines vertical correction signal $A_VS^V$ and vertical position signal $A_{VP}$ to generate vertical correction signal $A'_VS^{V_1}$. Vertical correction signal $A'_VS^{V_1}$ can be equivalent to vertical deflection current signal $I_V$, or vertical correction signal $A'_VS^{V_1}$ can be further processed (e.g., amplified) prior to becoming vertical deflection current signal $I_V$.

It should be recognized that deflection generator circuit 600 can also include other circuitry. For example, deflection generator circuit 600 may include a second-order signal generator, a second-order amplitude signal generator, and a multiplier for multiplying the second-order signal with the second-order amplitude signal to produce a second-order vertical correction signal component. The second-order vertical correction signal component can then be combined with the other vertical correction signal components in signal combiner 620. The second-order vertical correction signal provides what is commonly referred to as C correction. The second-order vertical correction signal or C correction signal is used to compensate for asymmetry in the vertical deflection coil.

While particular embodiments of the present invention have been shown and described, it will be apparent to those skilled in the art that changes and modifications may be made without departing from this invention in its broader aspect and, therefore, the appended claims are to encompass within their scope all such changes and modifications as fall within the true spirit of this invention.

What is claimed is:

1. A circuit that allows the amplitudes of vertical correction signal components to be adjusted independently, the circuit comprising:

a first signal combiner having a first input coupled to receive a first-order amplitude signal and a second input coupled to receive a third-order amplitude signal;

a first multiplier having a first input coupled to receive a first-order signal and a second input coupled to receive an output signal of the first signal combiner;

a second multiplier having a first input coupled to receive a third-order signal and a second input coupled to receive the third-order amplitude signal; and a second signal combiner having a first input coupled to receive an output signal of the first multiplier and a second input coupled to receive an output signal of the second multiplier.

2. The circuit of claim 1 wherein the first signal combiner includes a third input coupled to receive a fifth-order amplitude signal.

3. The circuit of claim 1 further comprising a third multiplier having a first input coupled to receive a fifth-order signal and a second input coupled to receive a fifth-order amplitude signal.

4. The circuit of claim 1 wherein the second signal combiner includes a third input coupled to receive an output signal of a third multiplier.

5. The circuit of claim 1 further comprising a fourth multiplier having a first input coupled to receive a second-order signal and a second input coupled to receive a second-order amplitude signal.

6. The circuit of claim 1 wherein the second signal combiner includes a third input coupled to receive an output signal of a fourth multiplier.

7. The circuit of claim 1 further comprising:

a first-order signal generator operable to generate the first-order signal; and a third-order signal generator operable to generate the third-order signal.

8. The circuit of claim 1 further comprising:

a first-order amplitude signal generator operable to generate the first-order amplitude signal; and a third-order amplitude signal generator operable to generate the third-order amplitude signal.

9. The circuit of claim 1 further comprising an independent top and bottom correction circuit that allows for independent S corrections to the top half and the bottom half of a raster display.

10. The circuit of claim 1 wherein the circuit is implemented on a single integrated circuit device.

11. A method that allows the amplitudes of vertical correction signal components to be adjusted independently, the method comprising:

combining a first-order amplitude signal with a third-order amplitude signal to generate a modified first-order amplitude signal;

multiplying a first-order signal with the modified first-order amplitude signal to generate a first-order vertical correction signal component;

multiplying a third-order signal with the third-order amplitude signal to generate a third-order vertical correction signal component; and combining the first-order vertical correction signal component with the third-order vertical correction signal component.

12. The method of claim 11 further comprising combining the first-order amplitude signal with the third-order amplitude signal and a fifth-order amplitude signal to generate the modified first-order amplitude signal.

13. The method of claim 11 further comprising multiplying a fifth-order signal with a fifth-order amplitude signal to generate a fifth-order vertical correction signal component.

14. The method of claim 11 further comprising combining the first-order vertical correction signal component with the third-order vertical correction signal component and a fifth-order vertical correction signal component.

15. The method of claim 11 further comprising multiplying a second-order signal with a second-order amplitude signal to generate a second-order vertical correction signal component.

16. The method of claim 11 further comprising combining the first-order vertical correction signal component with the third-order vertical correction signal component and a second-order vertical correction signal component.

17. The method of claim 11 further comprising:

generating the first-order signal; and generating the third-order signal.

18. The method of claim 11 further comprising:

generating the first-order amplitude signal; and generating the third-order amplitude signal.

19. The method of claim 11 further comprising:

generating a third-order top amplitude signal;

generating a third-order bottom amplitude; and generating the third-order amplitude signal by selecting the third-order top amplitude signal or the third-order bottom amplitude signal.

20. The method of claim 11 wherein the method is performed on a single integrated circuit device.

21. A method for generating a vertical deflection current signal including a first vertical correction signal component and a second vertical correction component, the method comprising:

setting an amplitude of the first vertical correction signal component; and setting an amplitude of the second vertical correction signal component, wherein the amplitude of the first vertical correction signal component will not have to be reset after the amplitude of the second vertical correction signal component has been set.

22. The method of claim 21 further comprising:

setting an amplitude of a third vertical correction signal component, wherein the vertical deflection current signal includes the third vertical correction signal component, and wherein the amplitude of the first vertical correction signal component will not have to be reset after the amplitude of the third vertical correction signal component has been set.

23. The method of claim 21 wherein the method is performed on a single ted circuit device.

* * * * *